US009313852B2

(12) United States Patent
Abbo et al.

(10) Patent No.: US 9,313,852 B2
(45) Date of Patent: Apr. 12, 2016

(54) LED DRIVER WITH EXTERNAL TEMPERATURE-COMPENSATED ILLUMINATION CONTROL SIGNAL MODULATOR

(71) Applicant: KONINKLIJKE PHILIPS N.V., Eindhoven (NL)

(72) Inventors: Anteneh Alemu Abbo, Eindhoven (NL); Johan-Paul Marie Gerard Linnartz, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/399,769

(22) PCT Filed: May 8, 2013

(86) PCT No.: PCT/IB2013/053695

§ 371 (c)(1),
(2) Date: Nov. 7, 2014

(87) PCT Pub. No.: WO2013/168104

PCT Pub. Date: Nov. 14, 2013

(65) Prior Publication Data

US 2015/0130366 A1 May 14, 2015

Related U.S. Application Data

(60) Provisional application No. 61/645,102, filed on May 10, 2012.

(51) Int. Cl.
*H05B 33/08* (2006.01)

(52) U.S. Cl.
CPC ..... *H05B 33/0845* (2013.01); *H05B 33/0854* (2013.01)

(58) Field of Classification Search
CPC ..... H05B 33/0815; H05B 33/0851; H05B 33/0842; H05B 33/0848; H05B 33/0839; H05B 33/0854; H05B 33/0866; H05B 33/083; H05B 37/02
See application file for complete search history.

(56) References Cited

U.S. PATENT DOCUMENTS

2003/0206426 A1 11/2003 Lin et al.
2004/0085791 A1 5/2004 Lin et al.

(Continued)

FOREIGN PATENT DOCUMENTS

EP 2355621 A2 8/2011
EP 2375860 A2 10/2011
WO 2011079184 A2 6/2011

*Primary Examiner* — Douglas W Owens
*Assistant Examiner* — Raymond R Chai
(74) *Attorney, Agent, or Firm* — Meenakshy Chakravorty

(57) ABSTRACT

The present invention concerns LED drivers and is in particular directed to signal overlay for feature addition to an existing LED driver. Specifically, the invention is directed to an apparatus (200) for operating a LED driver (100), to a method of operating a LED driver, to a computer program for operating a LED driver and to a LED driver unit. The apparatus (200) is capable of overlaying an overlay signal (digital or analogue) to a control signal (164) of the LED driver (100) in dependence of external control information (256). The control signal (164) is provided to the LED driver at a control signal inlet (105). By overlaying the overlay signal, the apparatus (200) modulates the control signal (164) and provides a modulated control signal (164) to the same control signal inlet (105).

14 Claims, 10 Drawing Sheets

(56) References Cited

U.S. PATENT DOCUMENTS

| | | | | |
|---|---|---|---|---|
| 2006/0290209 | A1 | 12/2006 | Bouchard et al. | |
| 2008/0079371 | A1 | 4/2008 | Kang et al. | |
| 2010/0141159 | A1 | 6/2010 | Shiu et al. | |
| 2010/0301777 | A1 | 12/2010 | Kraemer | |
| 2010/0308747 | A1* | 12/2010 | Tan et al. | 315/307 |
| 2011/0199013 | A1 | 8/2011 | Cottrell | |
| 2011/0273282 | A1 | 11/2011 | Ohsawa | |
| 2011/0304272 | A1 | 12/2011 | Ng et al. | |
| 2013/0181611 | A1* | 7/2013 | Pan | 315/151 |

* cited by examiner

-PRIOR ART-

LED DRIVER WITH EXTERNAL TEMPERATURE-COMPENSATED ILLUMINATION CONTROL SIGNAL MODULATOR

CROSS-REFERENCE TO PRIOR APPLICATIONS

This application is the U.S. National Phase application under 35 U.S.C. §371 of International Application No. PCT/IB2013/053695, filed on May 8, 2013, which claims the benefit of U.S. Provisional Patent Application No. 61/645,102, filed on May 10, 2012. These applications are hereby incorporated by reference herein.

FIELD OF THE INVENTION

The invention is directed to an apparatus for operating a light emitting diode (LED) driver, to a method of operating a LED driver, to a computer program for operating a LED driver and to a LED driver unit. In particular, the invention relates to signal overlaying techniques in order to add features to a conventional LED driver.

BACKGROUND OF THE INVENTION

US 2011/0199013 A1 describes a LED driver for controlling a LED array. A temperature sensor that measures a temperature of the LED array is coupled to the LED driver and provides the same with a corresponding measured temperature value. The LED driver can control the LED driver in dependence of the measured temperature value. The measured temperature value serves as a control signal that allows the LED driver to operate the LED array, such that the LED array temperature remains constant irrespectively of the ambient temperature.

SUMMARY OF THE INVENTION

An object of the present invention is to increase the functionality of a LED driver.

In a first aspect of the present invention, an apparatus for operating a LED driver is presented, wherein the apparatus is configured to be coupled to the LED driver and comprises:

- an input configured to capture a value of a control signal, wherein the control signal is to be provided at a control signal inlet of the LED driver, such that the LED driver can control operation of a LED based on the provided control signal, and
- a modulator configured to modulate the control signal according to a predefined protocol and to provide the modulated control signal at the same control signal inlet.

The present invention includes the recognition that an inherent behavior of a LED requires a corresponding LED driver to include some driver electronics that allow for controlling the LED such that both a long life-time and good light quality can be achieved. It has furthermore been recognized that an internal control circuit used in such conventional LED driver usually includes some predefined interfaces which makes upgrading by adding further functions/features rather complicated and expensive. An effective upgrading of existing LED drivers is in particular problematic, since there are, on the one side, a plurality of different LED topologies, which differ, e.g., in a number of control channels and/or in a spectral composition, and, on the other side, a plurality of different applications. For example, some drivers allow for dimming a LED while others allow for adjusting a color emitted by the LED.

It has been recognized that LED drivers are nowadays usually equipped with a programmable generic integrated circuit (IC), which shall render an eventual adaption process less complex. For example, such generic IC is programmed at a final stage of a corresponding lamp manufacturing process.

However, there is still a significant restriction as far as the availability of interfaces is concerned. In other words, the number of input signals that can be fed to the LED driver is limited. Therefore, it is difficult to accommodate new features to an existing LED driver. Eventually, it would rather be necessary to design an entirely new LED driver that allows control of a LED in dependence of a new input signal.

The present invention further includes the recognition that an existing LED driver has some inputs for monitoring control signals with slow dynamics, e.g. a temperature of a board bridge the LED driver is mounted, even though the IC of the LED driver is capable of sensing input signals that change much faster than the board temperature.

The proposed apparatus for operating a LED driver, in the following also simply referred to as apparatus, overcomes the afore-mentioned deficiencies of the prior art.

Generally spoken, the apparatus allows for introducing new control information via the generated modulated control signal that is provided at the same control signal inlet as the non-modulated control signal, i.e., to an interface that is used primarily for a different purpose. The fact that the primary function of the LED driver is implemented in dependence of a slow dynamic non-modulated control signal indicates that overlaying a comparatively high dynamical signal does not disturb the intended use of the existing LED driver. Thus, the apparatus preserves the primary use case of the existing LED driver. Consequently, it is now possible to extend the application scope of a conventional LED driver. In other words, external control information can be introduced to a LED driver directly by using existing internal sensor interfaces.

The interface restriction is circumvented by exploiting the programmability feature of an integrated circuit and combining it with a signal overlay technique that, on the one hand, preserves the primary intended function of the LED driver and, on the other hand, allows for adding new features to the LED driver, i.e. to the lighting solution. For this feature addition to be implementable, it is not necessary to completely redesign an entire LED driver. Therefore, a low cost and a low complex extension of application scope can be achieved.

For example, it is now possible to integrate a dimming function to an existing LED driver by modulating the control signal in dependence of a manual remote control or in dependence of an automatic day-light sensor signal.

As explained above, the non-modulated control signal to be provided at the control signal inlet of the LED driver is usually a signal of slow dynamics, for example, a board temperature. Such temperature can be measured by determining a voltage/a current at a negative/positive temperature coefficient resistor to which a constant current/a constant voltage is provided. For example, there is a defined minimum temperature, below which the LED is turned-off, and there is a maximum temperature, above which the LED is also turned-off. The primary function of the LED driver can thus be to either shut down or reduce operating current of the LED when the temperature exceeds the maximum temperature or falls below the minimum temperature. The LED driver reads the control signal in the range between voltage/current values corresponding to these limit temperatures. This observation can be used to develop a signal overlay protocol that generates events detectable by the internal control circuit to convey new control information with the modulated control signal, as will be explained in more detail below.

The modulator modulates the control signal according to the predefined protocol and generates a modulated control signal that is fed to the LED driver. The predefined protocol thus specifies how the control signal is to be modulated. For example, the protocol defines a pulse width modulation scheme and/or an amplitude modulation scheme and/or a frequency modulation scheme. There are various possibilities of modulation the control signal.

For example, the modulator modulates the control signal by adding a digital or an analogue signal to the control signal. The modulator can also modulate the control signal by varying one or more of its characteristic, such as a pulse width/a duty cycle, a frequency and/or an amplitude.

For example, the apparatus is coupled to the LED driver via a signal combiner that combines the control signal with a modulation output signal from the modulator. The generated modulated control signal fed to the LED driver can include control commands according to which the LED driver controls a LED, for example by changing the intensity of the emitted light and/or by changing the spectrum of the emitted light.

Within the scope of describing the present invention, the wording "control signal" refers to a signal that is sensed by the LED driver at a specific control signal inlet, e.g. a pin belonging to an integrated circuit of the LED driver, such that the LED driver can control operation of a LED in dependence of the sensed control signal. For example, the control signal is a signal that is conventionally used by the LED driver to control operation of the LED, i.e. a basic control signal that is already present in a conventional LED driver. The control signal can thus indicate a temperature of a board to which the LED driver is mounted, a temperature of a LED/a LED array to be driven, an ON/OFF-command, a light intensity in the environment, a load current/load voltage. The control signal can, e.g., originate within a housing of the LED driver but it can also come into being outside of such housing.

It is generally preferred that an internal control circuit of the LED driver is also adapted to the predefined protocol, such that the LED driver can control operation of the LED in dependence of the modulated control signal. Such adapting usually involves only a minor software/firmware update. For example, timer-based events can be used to interpret the modulated control signal, if the modulation is implemented with a pulse width modulation. Alternatively or additionally, comparators with adjustable thresholds can be used for interpreting the modulated control signal, if the modulation is an amplitude modulation. Usually, at least a timer and/or a comparator is present in a conventional LED driver.

For example, the set-up of the LED driver to be operated by the apparatus corresponds to the set-up of the LED driver CS1610 from Cirrus Logic. Such a LED driver has hardware resources that allow for said adapting, such as a timer, a comparator, an Analog-to-Digital Converter and/or a Digital-to-Analog-Converter or any combination thereof.

In an embodiment, the modulator of the apparatus is configured to modulate the control signal in dependence of the captured control signal value.

Knowledge about the primary control function, i.e. about operation of the LED driver in dependence of the non-modulated internal control signal, is advantageous when developing the signal overlaying format, i.e. the predefined protocol, and for excluding malfunction modes as described in the paragraphs below. During normal/primary operation mode of the LED driver, however, the actual value of the control signal is not a necessity for the overlaying process, i.e. the modulating process. Rather, the control signal is simply passed on to the driver.

Preferably, the modulator is configured to modulate the control signal only, if the captured control signal value is inside a predefined range, and to leave the control signal non-modulated, if the captured control signal value is outside the predefined range. For example, it might occur that the non-modulated control signal indicates to the LED driver that the LED must not be operated, e.g., due to an exceed of a temperature value, e.g. a temperature value that is indicative for a temperature of a board to which the LED driver is mounted or a component of the LED/the LED array to be driven. For example, the non-modulated control signal indicates that a board temperature is either too high or too low for operating the LED. In such case, it can be advisable that the control signal remains non-modulated. Thereby, damage of the LED can be avoided.

The predefined range can be specified within the protocol. Modulation of the control signal in dependence of the captured control signal value is furthermore advantageous, as this allows for implementation of a feedback control. Thereby, the modulator can modulate the control signal more accurately.

In another embodiment, the apparatus additionally comprises trigger means that are configured to cause a transition of the control signal value from an inside of a predefined range to an outside of the predefined range, the transition of the control signal value being indicative to the LED driver of an initiation and/or of a termination of a modulating of the control signal.

The trigger means can be an integral part of the modulator.

The trigger means of the apparatus informs the LED driver by quickly pulling the control signal value well below a lower boundary of the predefined range or, respectively, by quickly pushing the control value well above an upper boundary of the predefined range. This event can inform the LED driver that a new command is going to occur after some predefined time interval.

Preferably, the trigger means is configured to cause a comparatively fast transition of the control signal value, such that the forced transition of the control signal value is clearly different from a natural transition of the control signal value induced, e.g. by a temperature change. For example, the control signal is a voltage that corresponds to a board temperature or to any other parameter to be monitored which usually changes rather slowly over time. The transition from the control signal value from the predefined range to an outside of the predefined range shall occur, e.g., within a few milliseconds. Preferably, the trigger means are configured to cause the transition of internal control signal value within less than 100 ms.

In the embodiment, in which the control signal indicates a temperature, e.g. a temperature of a board to which the LED driver/the LED/the LED array is mounted, the dynamics, i.e. the rate of change, of the non-modulated internal control signal depends on the thermal design of the entire LED system, an applied cooling method and/or a heat sink size. The temperature change could take, e.g., from seconds to minutes to settle to a new control signal value. This is slow enough to introduce fast transitions of the overlay signal, i.e. the modulated internal control signal. Preferably, the trigger means and the modulator are configured to transfer the overlay information, i.e. the information encoded in the modulated control signal, sufficiently fast enough in order to also meet LED application latency requirements, i.e. the time constraints that are present at the LED driver to be operated.

Preferentially, the trigger means is configured to drive the control signal value to a first level, the first level being either below or above the predefined range and indicating to the LED driver that modulating of the control signal will be initiated, and/or to drive the control signal value to a second level, the second level being either above or below the predefined range and indicating to the LED driver that modulating of the control signal will be terminated.

Again, it is preferred that the trigger means is configured to drive the control signal value out of the predefined range comparatively quickly. Such a forced transition of the control signal value is easy to detect for the LED driver. During the two transitions of the control signal value, the apparatus can modulate the control signal and thus convey information, in particular control information, to the LED driver.

In another embodiment, the modulator is configured to perform a start pulse width modulation scheme and/or an end pulse width modulation scheme on the control signal, wherein the start pulse width modulation scheme is indicative to the LED driver that modulation of the control signal will be initiated and wherein the end pulse width modulation scheme is indicative to the LED driver that modulation of the control signal will be terminated.

In this embodiment, the LED driver is alternatively or additionally informed by a certain modulation scheme about the initiation or, respectively, termination of the modulation. For identifying such a modulation scheme, the LED driver can comprise a corresponding timer or, respectively, a detector that is capable of detecting pulse width modulation schemes.

In a particular preferred embodiment, the apparatus is configured to control the LED driver such that the LED driver operates in a normal state, in which a LED is controlled in dependence of the non-modulated control signal, and the LED driver operates in a dynamic state, in which a LED is controlled in dependence of the modulated control signal.

For example, the apparatus can indicate to the LED driver, e.g., by performing a start pulse width with modulation scheme on the control signal or, respectively, by driving the control signal value above the predefined range, that the control signal will be modulated and that control information will be conveyed to the LED driver. In this state, the LED driver is considered to be in the dynamic state, in which the LED is controlled in dependence of the modulated control signal.

It is emphasized that even if the LED driver operates in the dynamic state, the information of the non-modulated control signal must not necessarily be lost. For example, if the control signal is a voltage level indicating a temperature of a board of the LED driver, the control signal can be modulated, such that the mean value of the modulated control signal is identical to the mean value of the non-modulated control signal. Therefore, in an embodiment, the modulator is configured to modulate the control signal such that the information contained in the non-modulated control signal is preserved and also provided at the control signal inlet.

In another preferred embodiment, the apparatus additionally comprises a control interface coupled to the modulator, the control interface being configured to receive an external control signal originating from an environment of the LED driver, and to control modulation of the control signal in dependence of the received external control signal.

In this embodiment, a LED operated by a LED driver can be externally controlled. The control interface is coupled to the modulator, such that the modulator can perform modulation of the control signal in dependence of the received external control signal.

In an embodiment, the control interface includes a light sensor and the external control signal is inducible by a change of light occurring in an environment of the LED driver. Thus, if it is relatively dark in the environment, the LED can automatically be turned-on and if the environment is naturally relatively light, the LED can be turned-off again. Thereby, a day-light control can be added to an existing LED driver.

For example, the light sensor is a digital sensor delivering a piece of data indicative of light level/intensity, such as a byte that indicates one of 255 light levels. Alternatively, the light sensor is an analogue sensor that delivers a voltage value indicative of a light level.

In another variant, the control interface includes an infrared sensor and the external control signal includes an infrared signal. This embodiment allows for control of the LED via a remote control, for example. Besides a simple turn-on and turn-off function, a dimming function can be implemented. For example, a dimming control signal can be transmitted by a remote control to the control interface, i.e. the infrared sensor and the modulator of the apparatus modulates the control signal in dependence of the signal received by the infrared sensor. The modulated control signal instructs the LED driver to either increase the intensity of the light emitted by the LED or, respectively, to decrease the intensity of the light emitted by the LED.

Preferably, the control interface and the modulator are implemented in an integrated device.

In another embodiment, a control interface is realized by an occupancy detection sensor, e.g. a motion detection sensor that works with, e.g., passive infrared sensing (PIR). Thereby, an automatic ON/OFF-control can be realized. The motion detection can be implemented with a temperature sensor. Thus, if an area to be supervised is not occupied by a person, the control signal is either pulled or pushed to a level which causes the LED driver to turn off the LED or, respectively, to reduce the intensity of the light emitted by the LED to a certain low light level. If the area supervised by the occupancy detection sensor is occupied by a person/an animal/an object, the occupancy detection sensor instructs the modulator to modulate the control signal such that the LED driver turns on the LED.

Preferably, a motion detection signal reaches the modulator in less than 100 ms for occupant acceptance when activating the light.

In another preferred embodiment, the modulator includes a switching array, wherein the switching array comprises a number of controllable switches and is configured to be set into a specific of a plurality of control states in dependence of respective switching states of the number of controllable switches;

each of the plurality of control states results in a respective specific control signal value; and wherein the modulator is configured to put the switching array into a specific control state in dependence of the external control signal.

This embodiment allows for a low complex and simple modulation of the control signal. For example, a switching array is coupled to light sensor and/or other sensors, such as an infrared sensor, and to the operating voltage of the LED driver. The output signals of the control interface, i.e. of the sensors, are coupled to an input side of the switching array and an output side of the switching array is coupled to the control signal inlet of the LED driver.

This embodiment is in particular preferred, if the control interface includes an analogue sensor delivering an analogue output signal, such as voltage. The modulator can then couple this analogue voltage directly to the control signal inlet of the LED driver, or, respectively, indirectly by adding/subtracting another analogue signal to/from the analogue sensor output signal.

For example, it is possible that the modulator subtracts a sensor output voltage from the operating voltage and provides a corresponding difference voltage to the control signal inlet of the LED driver.

It is furthermore possible that the modulator implements a pulse width modulation with the plurality of controllable switches in dependence of the sensor output signals by switching the number of controllable switches according to the predefined protocol. Thus, control information can be conveyed to the LED driver not only by modulating an amplitude, but also by modulating a frequency and/or a pulse width. Generally spoken, it is preferred that the modulator is configured to modulate one or more of the following parameters of the control signal: a frequency, an amplitude, a pulse width. For example, the modulator is adapted to perform such modulation by overlaying an analogue or digital signal on the control signal.

In the second aspect of the present invention, a LED driver unit for driving a LED is provided, wherein the LED driver unit comprises a LED driver and an apparatus according to the first aspect of the present invention.

Due to the apparatus, the LED driver unit exhibits an extended application range.

Preferentially, a programmable internal control circuit of the LED driver is adapted to the predefined protocol, such that the LED driver is capable of controlling the LED in dependence of the modulated control signal generated by the apparatus. In other words: It is preferred that the LED driver comprises a demodulator configured to demodulate the modulated control signal, such that the LED driver is capable of controlling the LED in dependence of the modulated control signal generated by the apparatus.

Usually, a conventional LED driver module is already equipped with hardware resources necessary for the named adaption. Such hardware resources can be, e.g., a timer, an analog-to-digital converter (ADC) and/or a comparator and/or a digital-to-analog converter (DAC) or any combination thereof. Such components can easily be configured such that the LED driver is capable of controlling the LED in dependence of the modulated control signal.

For example, a comparator of the LED driver can be programmed with one or more specific threshold values such that the LED driver recognizes a transition induced by the modulator. A timer of a LED driver can be programmed to cause an interrupt, such that the internal control circuit of the LED driver controls the LED in dependence of the modulated control signal. Thus, based on the interrupt from the timer, the internal control circuit reads the control signal and interprets it as values of the non-modulated control signal or of the modulated control signal. There are various possibilities to easily adapt the conventional LED driver such it can handle the modulated control signal and control the LED correspondingly.

In a preferred embodiment, the apparatus is operatively connected to the LED driver via an Analog-to-Digital-Converter of the LED driver, wherein the Analog-to-Digital-Converter is configured to receive the modulated or non-modulated control signal and to provide a digital control signal to the internal control circuit in dependence of the received signal.

In another embodiment, the LED driver comprises a comparator that is configured to detect a transition of the value of the control signal between an inside and an outside of a predefined range and to provide a comparator output signal to the internal control circuit of the LED driver, if such transition occurs, wherein the comparator output signal is indicative of an initiation or, respectively, a termination of a modulation of the control signal.

In further embodiment, the LED driver comprises a timer that is configured to provide an interrupt signal to the internal control circuit, wherein

- the LED driver is configured to operate in a normal state, in which a LED is controlled in dependence of the non-modulated control signal, if the interrupt signal is inactive, and
- the LED driver is configured to operate in a dynamic state, in which a LED is controlled in dependence of the modulated control signal, if the interrupt signal is active.

In a third aspect of the present invention, a method of operating a LED driver is presented, wherein the method comprises the steps of:

- capturing a value of a control signal, wherein the control signal is to be provided at a control signal inlet of the LED driver, such that the LED driver can control operation of a LED based on the provided control signal;
- modulating the control signal according to a predefined protocol; and
- providing the modulated control signal at the same control signal inlet.

The method of the third aspect of the present invention shares the advantages of the apparatus of the first aspect of the present invention.

In the fourth aspect of the present invention, a computer program for operating a LED driver is provided, wherein the computer program comprising program code means for causing the apparatus of the first aspect of the invention to carry out the steps of the method according to the second aspect of the invention, when the computer program is run on computer controlling the apparatus.

The computer program of the fourth aspect of the invention may be stored/distributed on a suitable medium, such as an optical storage medium or a solid-state medium supplied together with or as part of other hardware, but may also be distributed in other forms, such as via the Internet or other wired or wireless telecommunication systems.

It shall be understood that the apparatus of the first aspect of the invention, the LED driver unit of the second aspect of the invention, the operating method of the third aspect of the invention and the computer program of the fourth aspect of the invention have similar and/or identical preferred embodiments, in particular, as defined in the dependent claims.

It shall furthermore be understood that a preferred embodiment of the invention can also be any combination of the dependent claims with respective independent claims. For example, it is preferred that the apparatus comprises both the above-mentioned trigger means and a modulator being capable of performing said start pulse width modulation scheme and said end pulse width modulation scheme on the control signal. It is generally preferred that the apparatus is capable of setting the LED driver either in said normal state or in said dynamic state. It shall furthermore be understood that said control interface is preferentially present in addition to the trigger means and/or in addition to the specific modulator that is capable of performing said start/end pulse width modulation scheme.

Concerning the LED driver unit of the second aspect of the invention, it shall be understood that the LED driver preferentially comprises said comparator and said timer.

The invention can generally be applied anywhere where LED drivers are present, in particular at home applications such as light controls, at automotive applications, e.g. for adding day-light control to existing LED drivers for control indoor or outdoor lights, and generally within consumer electronics. The invention can also be applied in further low-cost micro-controller based solutions where interface access is restricted due to a low amount of pins.

Instead of merely modulating one single control signal, the modulator is, in an embodiment, capable of capturing and modulating a plurality of control signals. The invention is not restricted to modulating only one single control signal.

These and other aspects of the invention will be apparent from and elucidated with reference to the embodiments described hereinafter.

DETAILED DESCRIPTION OF EMBODIMENTS

Figure 1:
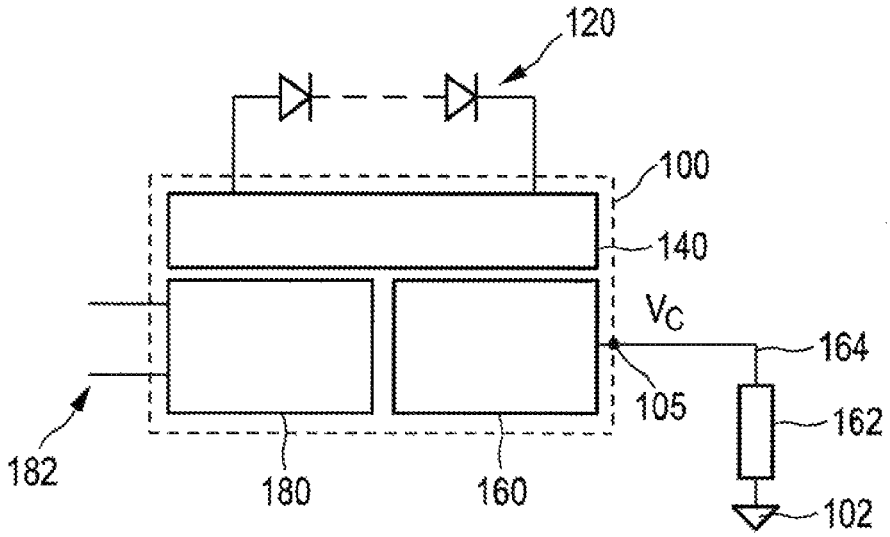
FIG. 1 shows schematically and exemplary a representation of a circuit topology of a conventional LED driver according to the prior art.

FIG. 1 shows schematically and exemplary a representation of a circuit topology of a LED driver 100 according to the prior art. The LED driver 100 controls operation of one or more LEDs 120. It is coupled to a power supply 182 via a mains interface 180 and comprises a programmable integrated circuit 160, which controls operation of a power conversion stage 140 that eventually provides a predefined current and/or a predefined voltage to the LED 120.

Conventionally, operation of the LED 120 is controlled in dependence of a slow dynamic control signal 164. In the example depicted in FIG. 1, the control signal 164 is generated via negative temperature coefficient resistor 162 that is coupled between the integrated circuit 160 and ground 102. Certainly, the control signal could also be generated via a different sensor, e.g. via a positive temperature coefficient resistor.

The voltage $V_C$ is provided at a control signal inlet 105 of the LED driver 100. The voltage $V_C$, i.e., the value of the control signal 164, is indicative of a temperature of a board to which the LED driver 100 is mounted (not shown).

Figure 10:
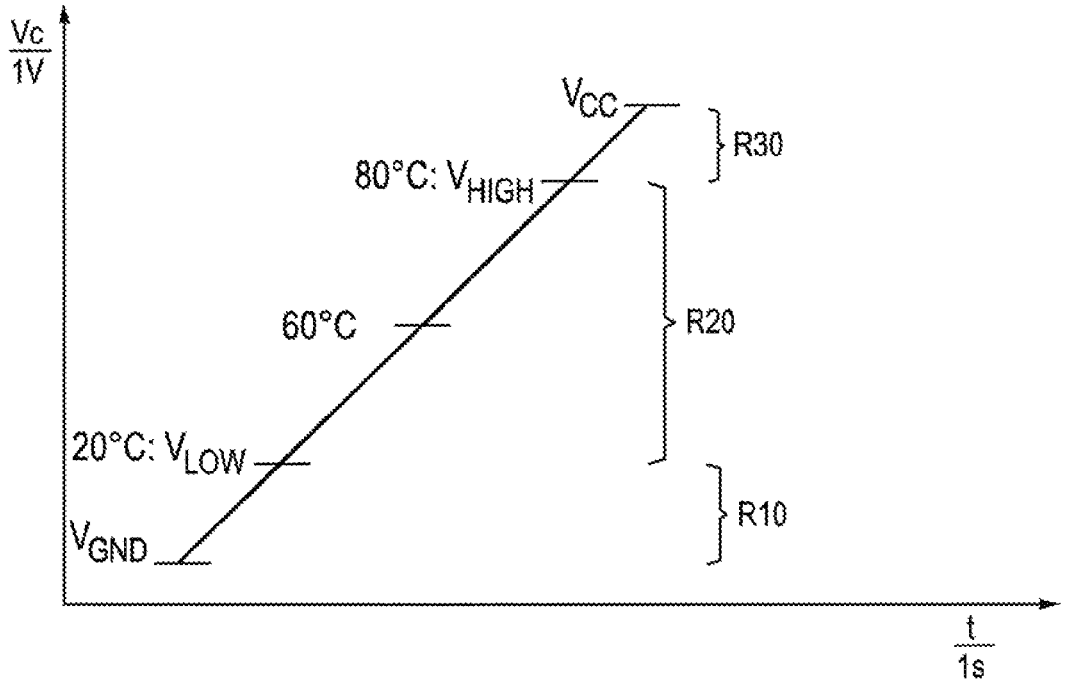
FIG. 10 shows exemplary a diagram illustrating a trend of a non-modulated control signal over time.

An exemplary trend of the value of the non-modulated control signal 164 is depicted in FIG. 10. Accordingly, if the value of the control signal 164 is within a predefined range R20, e.g., between a voltage value that corresponds to an exemplary temperature of 80° C. and a voltage value that corresponds to an exemplary temperature of 20°, the LED driver 100 is in a normal operating state. In other words, a current/voltage will be provided to the LED 120 in dependence of the value of the control signal 164. If the voltage $V_C$ rises above a value $V_{HIGH}$ that is indicative for an upper temperature limit (region R30), or respectively, if the voltage drops below a voltage level $V_{LOW}$ that is indicative for a lower temperature limit (region R10), the LED driver 100 reacts to this abnormal temperature range and controls operation of the LED 120 correspondingly. For example, if the voltage $V_C$ is within the range R30, the LED 120 may be turned-off or, respectively, the LED current may be reduced significantly.

Figure 2:
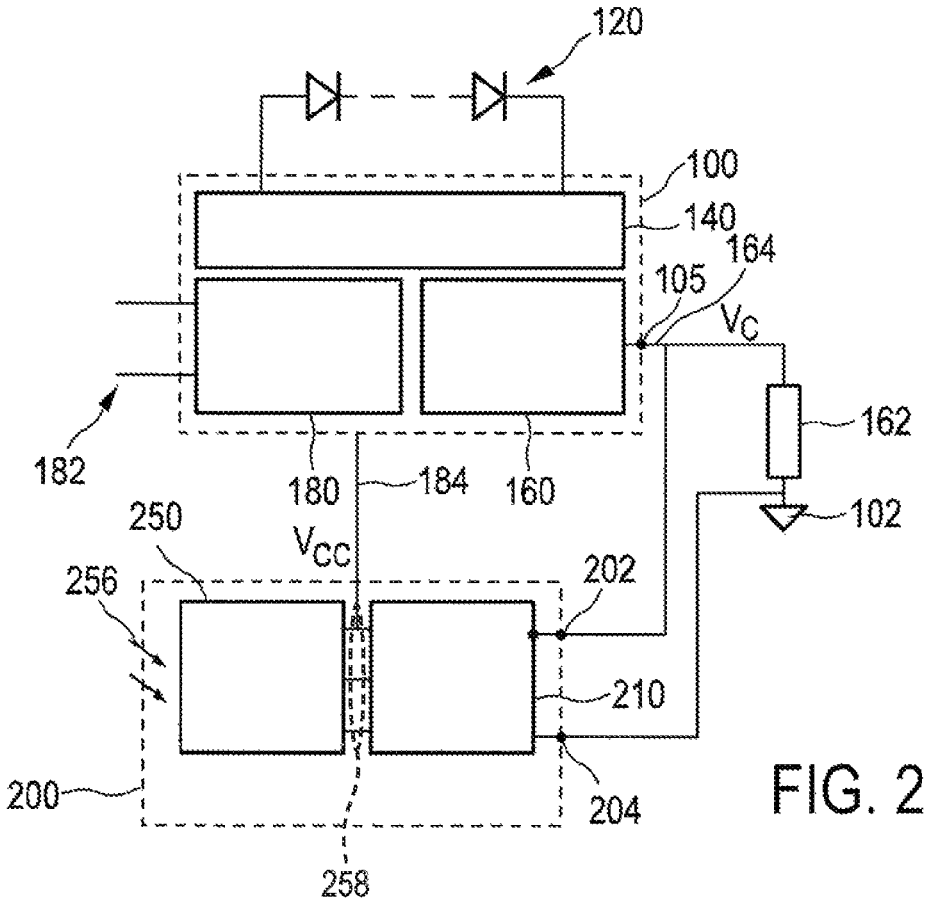
FIG. 2 shows schematically and exemplary a representation of a first embodiment of the apparatus for driving a LED in accordance with the first aspect of the invention.

FIG. 2 shows a first embodiment of the apparatus 200 for operating the conventional LED driver 100. The apparatus 200 is coupled to the operating voltage 184 ($V_{CC}$) and to ground 102. The apparatus 200 furthermore comprises an input 202 that captures a value of the control signal 164. The apparatus 200 comprises a modulator 210 that can modulate the control signal 164 according to a predefined protocol and provide the modulated control signal 164 at the same control signal inlet 105. For example, the modulator overlays a digital or an analog signal on the control signal 164. Additionally or alternatively, the modulator 210 modulates a frequency, an amplitude and/or a pulse width of the control signal 164. The programmable integrated circuit 160 of the conventional LED driver is also adapted to the predefined protocol, such that the LED driver can control operation of the LED 120 in dependence of the modulated control signal.

The apparatus 200 additionally comprises a control interface 250 that is coupled to the modulator 210 and that receives an external control signal 256 originating from an environment of the LED driver. The control interface 250 controls the modulation with the received external control signal. Therefore, the control interface 250 provides a control interface output signal 258 to the modulator 210. As will be elaborated in more detail below, such a control signal can be induced by change of light occurring in an environment of the LED driver and/or by temperature change caused by a presence of an object or by an infrared signal. The control interface transforms these external control signals into a modulator control signal, thereby controlling the modulation.

Figure 11:
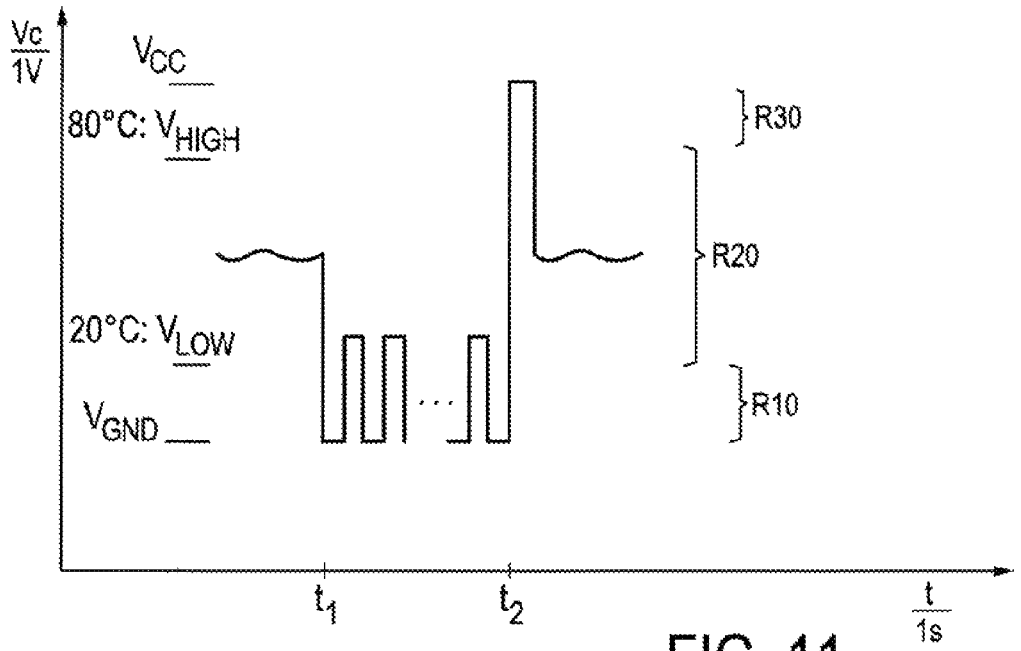
FIG. 11 shows exemplary a first trend of a modulated control signal over time and FIG. 12 shows exemplary a second trend of a modulated control signal over time.
Figure 12:
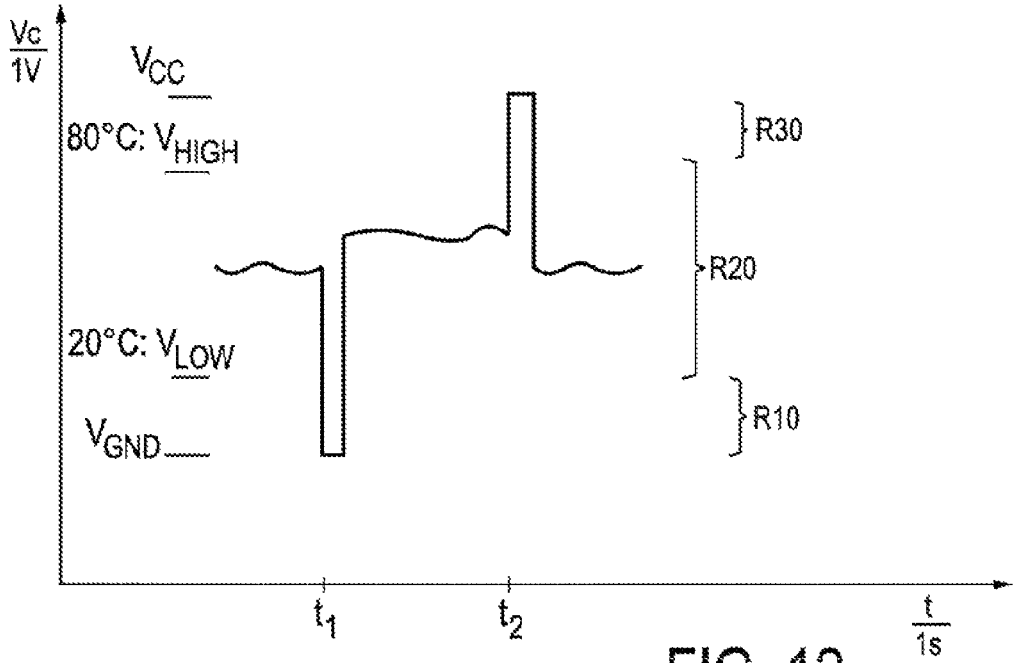

A trend of a modulated control signal 164 is depicted in FIG. 11 and in FIG. 12. The general set-up of the diagrams depicted in FIGS. 11 and 12 essentially corresponds to the set-up of the diagram depicted in FIG. 10. Prior to modulating the control signal 164, the modulator 200 causes a comparatively fast transition of the control signal value from an inside of the predefined range R20 to an outside of the predefined range (in FIGS. 11 and 12 to region R10). Such a comparatively fast transition of the control signal value is indicative to the LED driver 100 of an initiation of a modulation of the control signal 164. The comparatively fast transition of the control signal 164 to indicate start of the modulation occurs at a time $t_1$. In the example of FIG. 11, modulator 210 performs a pulse width modulation scheme on the control signal 164, thereby conveying data, i.e. control commands, to the LED driver 100. For example, the specific pulse width modulation can include a dimming command that instructs the LED driver 100 to cause either an increase or, respectively, a decrease of the intensity of the light emitted by the LED 120.

In the example of FIG. 12, the modulator conveys data to the LED driver 100 by varying the amplitude of the control signal 164. In both examples according to FIGS. 11 and 12, the modulation of the control signal occurs in the time interval $t_1<t<t_2$.

In order to indicate termination of the modulation of the control signal 164, the modulator 210 causes a comparatively fast transition of the value of the control signal 164 from an inside of the predefined range (R20) to an outside of the predefined range. This comparatively fast transition occurs at a time $t_2$. In the examples according to FIGS. 11 and 12, the latter transition occurs by pushing the control signal value well above the predefined range R20 into a range R30. Afterwards, a LED driver 100 controls operation of the LED 120 in dependence of the non-modulated control signal 164.

Figure 3:
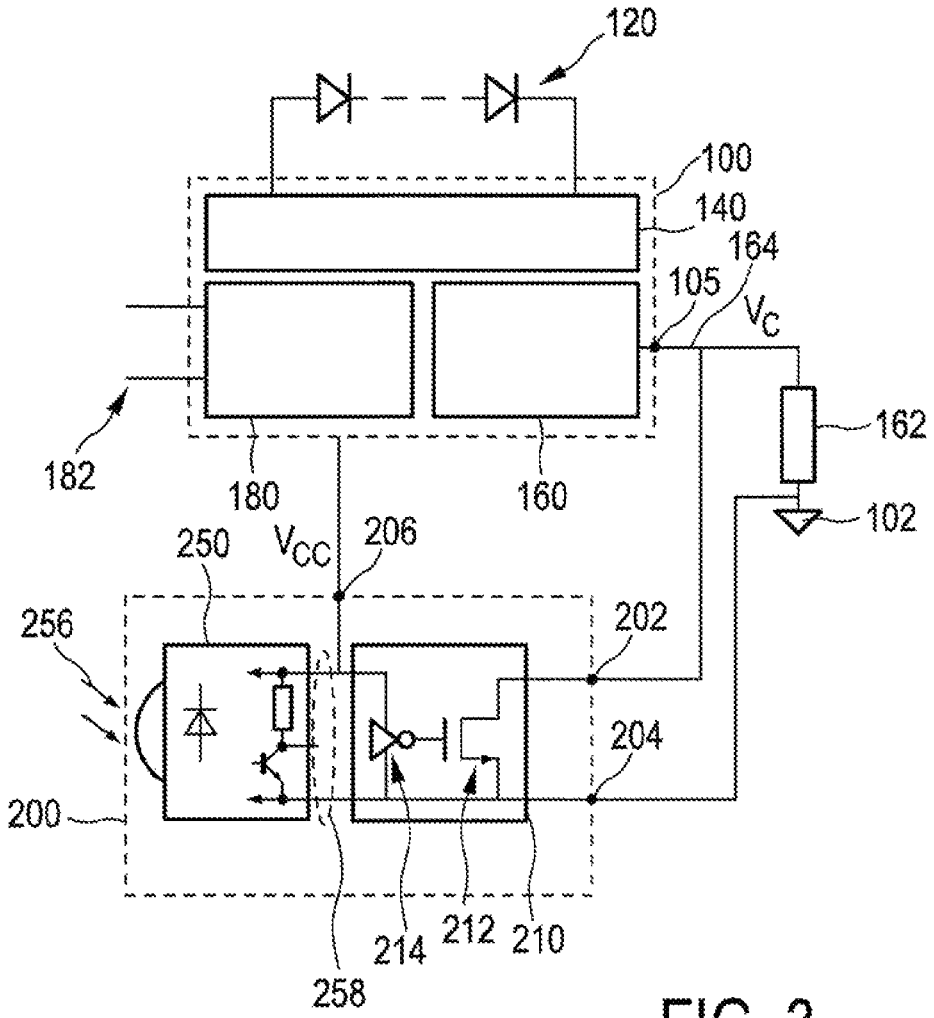
FIG. 3 shows schematically and exemplary a representation of a second embodiment of the apparatus for driving a LED in accordance with the first aspect of the invention.

FIG. 3 shows a further embodiment of the apparatus for operating a LED driver, wherein the control interface 250 is realized by an infrared receiver that receives external control signals 256 in the form of infrared signals, e.g., transmitted by a remote control (not shown). The control interface 250 provides the control interface output signal 258 to the modulator 210. According to the embodiment shown in FIG. 3, the modulator 200 comprises a transistor 212 that is controlled by a gate driver 214, which is in turn controlled by the control interface output signal 258. In this simple set-up, the apparatus 200 does not need to include any own logic, but is completely controlled by the external control signals 256. Thus the protocol, according to which modulation of the control signal 164 occurs, is not programmed within the apparatus 200 but is programmed, e.g., on a remote control that transmits the external control signal 256 to the apparatus 200.

Figure 4:
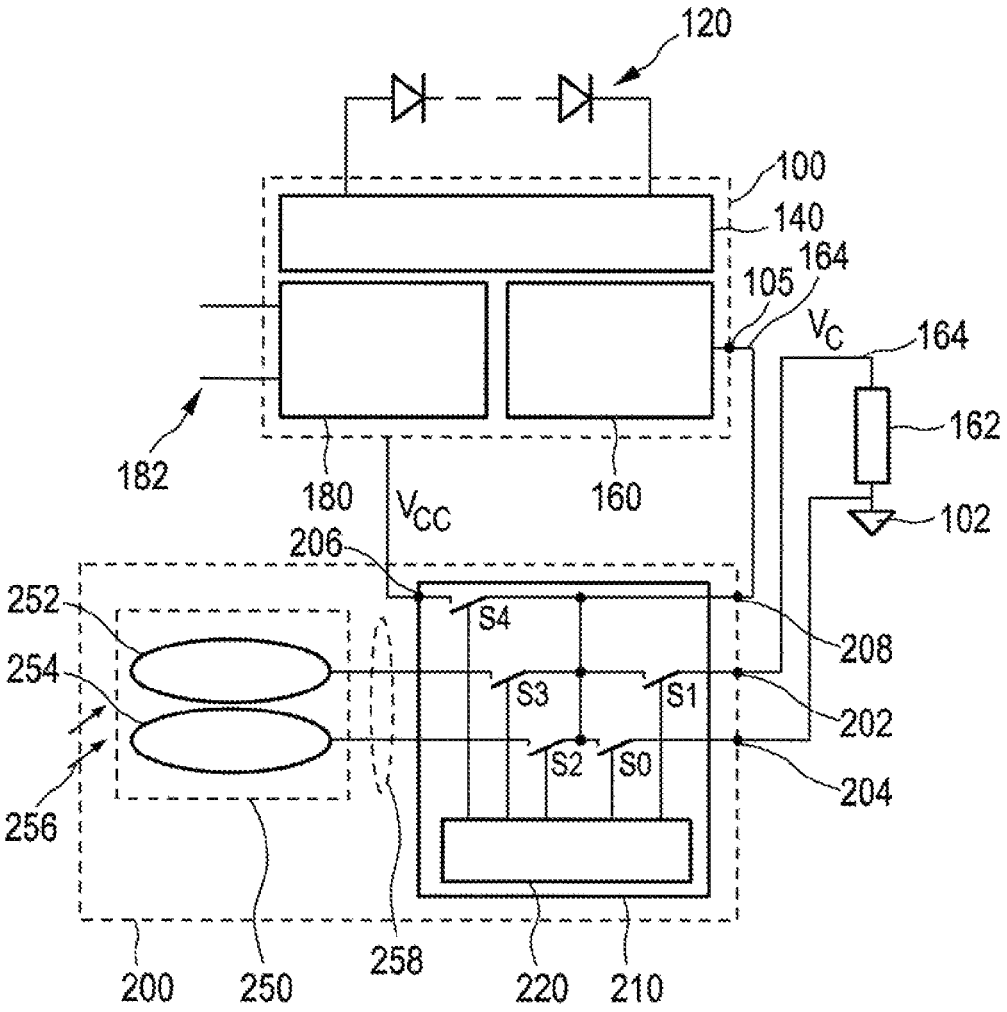
FIG. 4 shows schematically and exemplary a representation of a third embodiment of the apparatus for driving a LED in accordance with the first aspect of the invention.

In another embodiment that is depicted in FIG. 4, the modulator 210 comprises an own logic control 220, e.g. a sequencer, for controlling a switching array 222 comprising a plurality of switches S0, S1, S2, S3, S4. The switching array 222 interconnects the control interface 250, the operating voltage $V_{CC}$ and the control signal inlet 105 with each other. In this embodiment, the control interface 250 includes a light sensor 252 and one or more further sensors 254. Thereby a day-light control can be implemented. The control interface output signals 258, which are generated in dependence of the day-light, are fed to the switching array 222. If the control signal 164 shall remain non-modulated, the logic control 220 only closes switch S1 and leaves the other switches depicted in FIG. 4 in an open state. To inform the LED driver 100 that modulating of the control signal 164 will be initiated, the logic control 220 can shortly close either switch S4 or S0, causing a quick transition of the control signal value either in range R10 or in range R30. After such an indication has occurred, the logic control 220 may then close only switch S3, thereby providing the output signal of the light sensor 252 at the control signal inlet 105 of the LED driver. Depending on the actual set-up of the light sensor 252, a simple turn-on/turn-off function may be implemented in dependence of the surrounding day-light or, respectively, the light sensor 252 can provide an output signal that instructs the LED driver to regulate the light intensity emitted by the LED 120 in dependence of the day-light. The other sensor 254 can be, for example, an occupancy sensor that supervises an associated area and provides an output signal in dependence of presence/non-presence of an object in the supervised area. By closing only switch S2 and leaving the remaining switches open, the modulator 210 can provide, by using logic control 220, the output signal of the other signal 254 at the control signal inlet 105 of the LED driver 100. The sensors 252 and 254 can be of any type, depending on the designated application of the LED driver 100.

Figure 5:
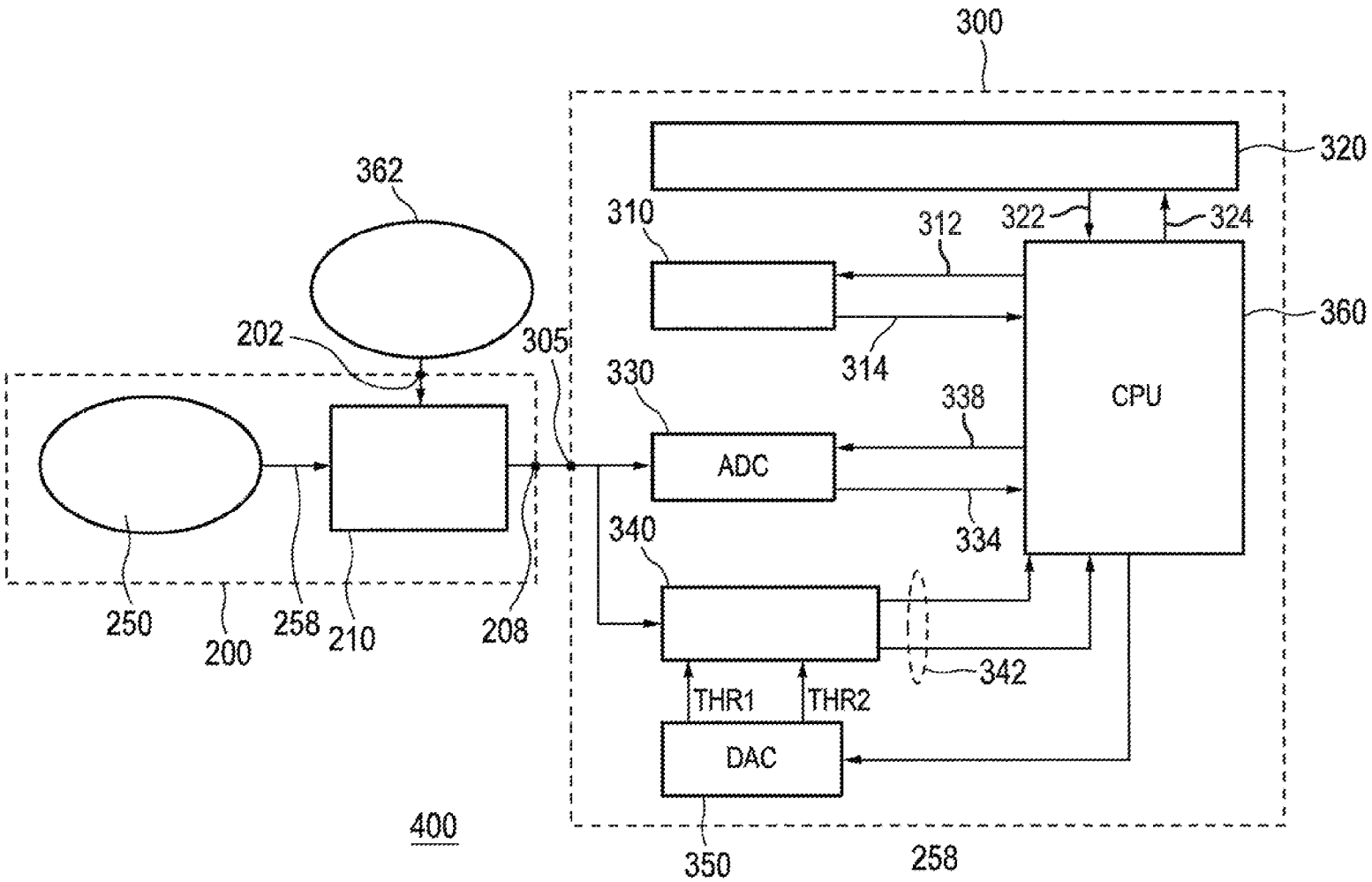
FIG. 5 shows schematically and exemplary a representation of a first embodiment of the LED driver unit in accordance with the second aspect of the invention.

FIG. 5 shows exemplary a set-up of an embodiment of a LED driver unit 400. The LED driver unit 400 comprises a LED driver 300 and an apparatus 200 for driving the LED driver 300.

The apparatus 200 has already been described with respect to FIGS. 2, 3 and 4 and shall not be explained again. The apparatus 200 is coupled to an internal sensor 362 of the LED driver 300 via input 202. The modulator 210 of the apparatus 200 provides either the modulated control signal or the non-modulated control signal to the LED driver via output 208 to a control signal inlet 305.

The LED driver 300 of the LED driver unit 400 has a conventional set-up. The control signal (either modulated or non-modulated) is provided to an analog-to-digital converter (ADC) 330. The CPU 360 can control the ADC 330 through an ADC control signal 338. The ADC 330 converts the analog control signal into a digital control signal 334 and provides the digital control signal 334 to a central processing unit (CPU) 360. The control signal is also provided to a comparator 340 of the LED driver 300. The CPU 360 can be programmed such that it controls the comparator 340 via a digital-to-analog converter (DAC) 350 by setting to a threshold value THR1 and THR2, which defines the afore-mentioned predefined range.

In dependence of the comparatively fast forced control signal value transitions that have been explained with respect to FIG. 11 and FIG. 12, the comparator 340 provides start and stop signals 342 to the CPU 360, wherein a start signal indicates initiation of a modulation of the control signal and wherein a stop signal indicates termination of a modulation of the control signal.

Additionally, the LED driver 300 conventionally includes a timer 310 that can also be configured via CPU 360. The CPU 360 can control the timer 310 through a timer control signal 312. The timer 310 causes an interrupt at the CPU by transmitting a corresponding interrupt signal 314. Based on the interrupt signal 314 from the timer 310, the CPU 360 reads output data 334 from the ADC 330 and interprets it either as a non-modulated control signal (internal sensor information) or as a modulated control signal (external overlayed information or external overlayed information plus primary internal sensor information). The CPU 360 controls further hardware modules 320 in dependence of either the modulated or the non-modulated control signal, such that a corresponding current/a corresponding voltage is provided to the LED to be driven (not shown). Control of the further hardware modules 320 occurs through first and second module control signals 322, 324.

Figure 6:
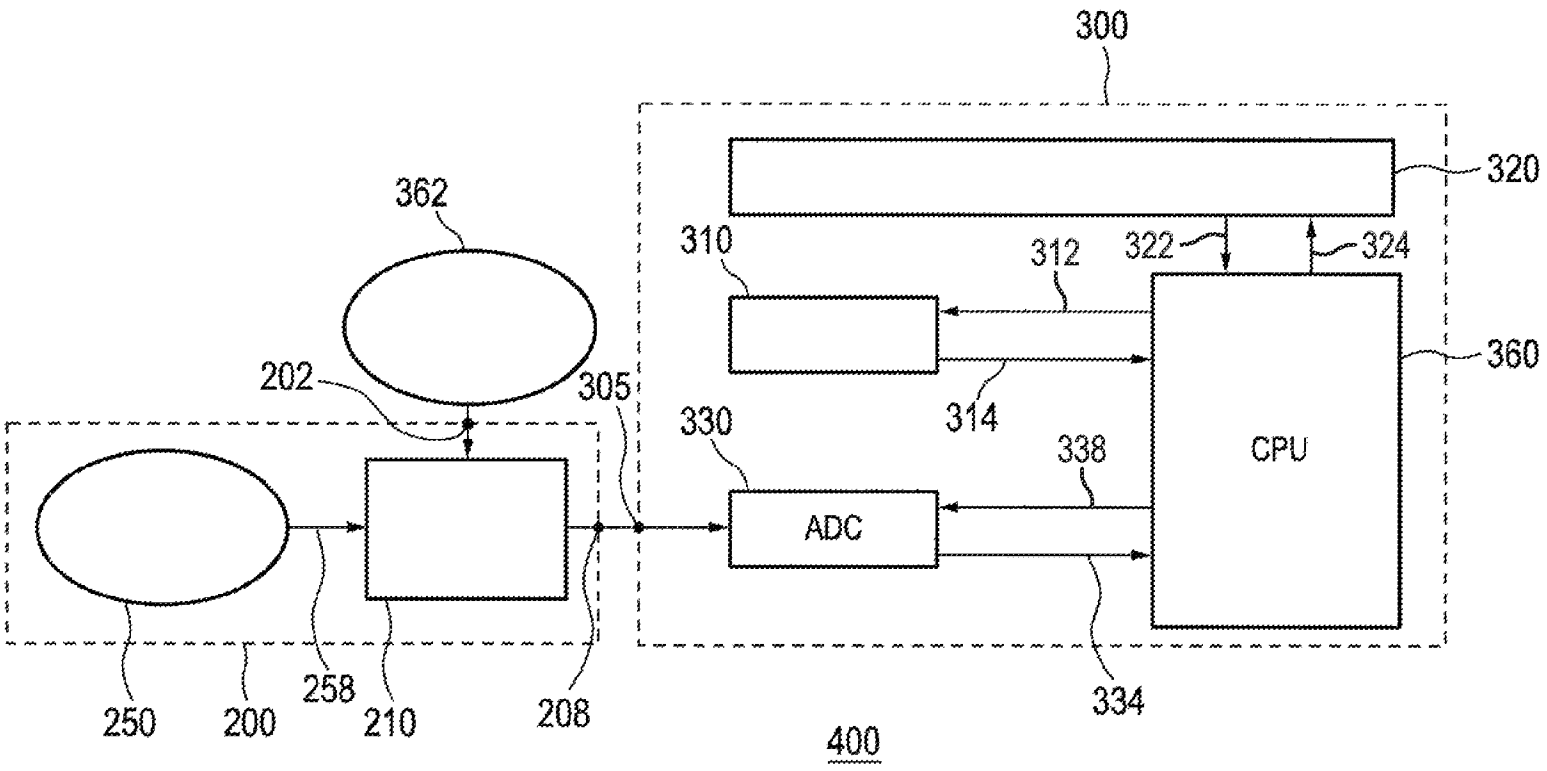
FIG. 6 shows schematically and exemplary a representation of a second embodiment of the LED driver unit in accordance with the second aspect of the invention.

FIG. 6 shows another embodiment of the LED driver unit 400. Whereas the apparatus 200 for operating the LED driver 300 has not changed, the LED driver 300 does not comprise a comparator or a DAC as explained with respect to FIG. 5 anymore but their functionality is replaced by a software function, which regularly monitors the ADC output data 334 of the ADC 330 to determine start and stop conditions. This allows the release of hardware resources that might be needed for other driver functionalities. Modulator 210 performs a certain start pulse width modulation scheme/end pulse width modulation scheme on the control signal in order to indicate to the LED driver 300 that modulation of the control signal will be initiated/terminated. The CPU 360 is programmed such that it recognizes these specific modulation schemes. Once a start pulse width modulation scheme has been recognized, the timer 310 provides a timer interrupt signal 314 to the CPU 360, such that the CPU interprets the control signal as a modulated control signal.

Figure 7:
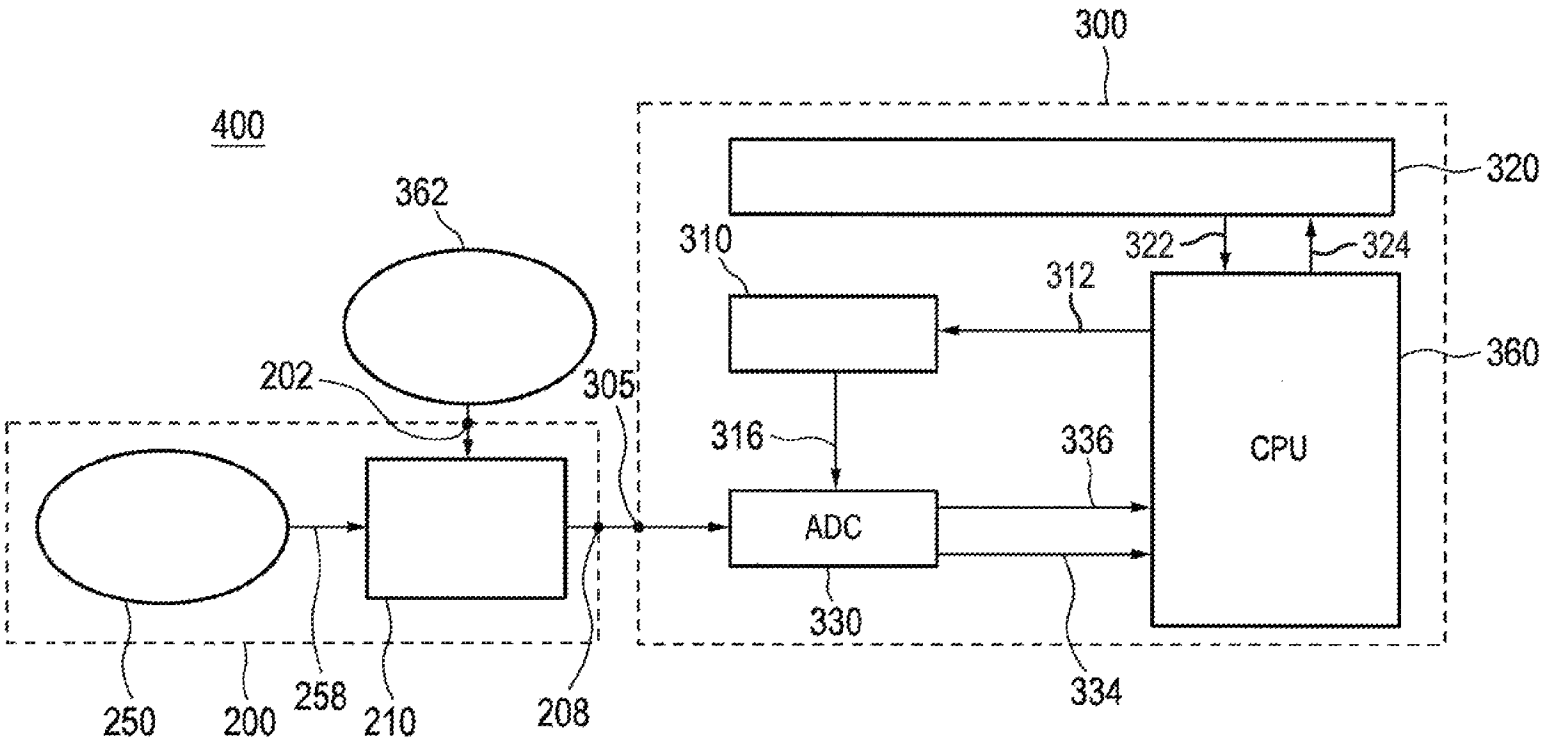
FIG. 7 shows schematically and exemplary a representation of a third embodiment of the LED driver unit in accordance with the second aspect of the invention.

A variation of the embodiment depicted in FIG. 6 is shown in FIG. 7. In this embodiment the ADC 330 is directly triggered by the timer 310 via a corresponding timer trigger signal 316. This has the advantage of relaxing the timing requirement for interrupt handling by the CPU 360, since the ADC conversion is initiated directly. Data buffering in the ADC allows for reading by the CPU 360 in relaxed timing constraint. The CPU 360 can control the timer 310 through a timer control signal 312.

In this embodiment, the timer 310 triggers the ADC 330 with the corresponding trigger signal 316 once it has been recognized that modulation of the control signal will be initiated/terminated. In response to receiving the trigger signal 316, the ADC 330 transmits an interrupt signal 336 to the CPU 360.

The initiation/termination information is derived through software from data buffered in the ADC 330. This is monitored by the CPU 360. The fact that the initiation and termination signal values/levels are distinctly different from the normal control signal values/levels allows the CPU 360 to perform subtraction of subsequent buffered samples and comparison of the subtraction results with thresholds to determine start and stop conditions. Alternatively, CPU 360 checks samples received from the ADC buffer to identify the first moments when the overlayed signal, i.e. the modulated control signal, falls in the regions R10 and R30 indicated in FIG. 11 and FIG. 12 to deduce start and stop conditions.

Figure 8:
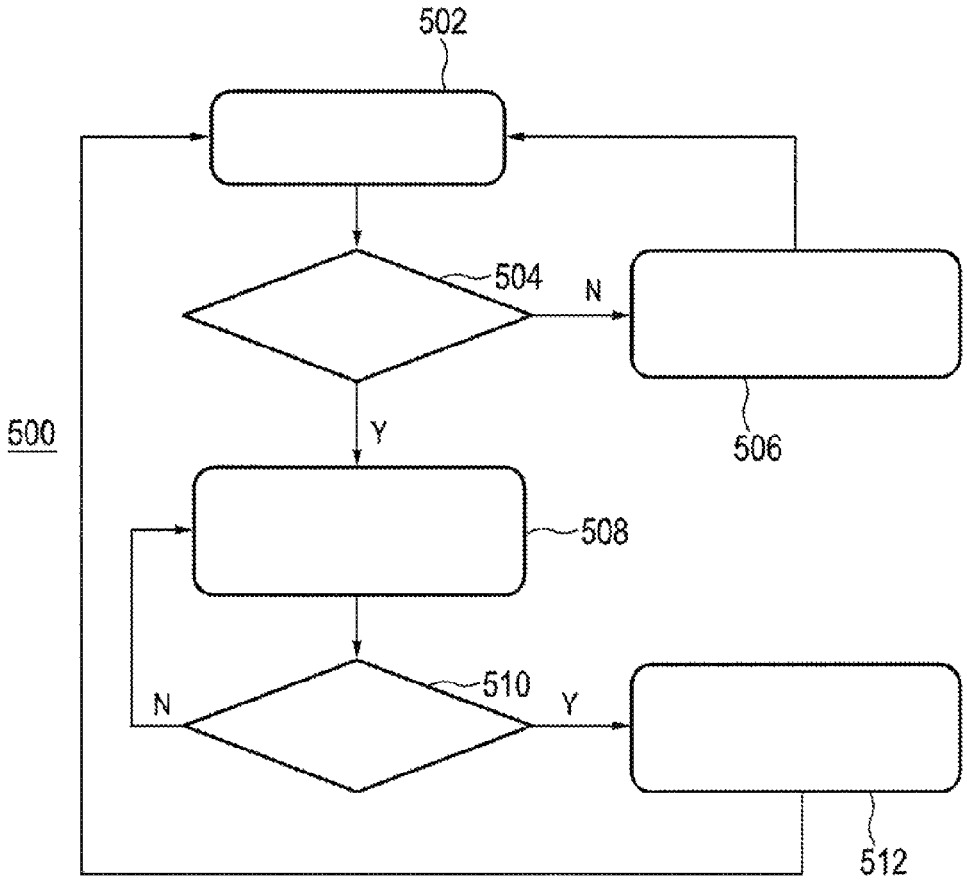
FIG. 8 shows exemplary a flowchart illustrating a first embodiment of a method for operating a LED driver.

FIG. 8 shows a first embodiment of a method of operating a LED driver that is controlled by an apparatus according to the first aspect of the invention.

In a first step 502, a value of the control signal 164 is captured. In a second step 504, it is checked whether it is indicated by the apparatus 200 to the LED driver that initiation of a modulating of the control signal 164 will occur. Such exemplary indication is illustrated in FIGS. 11 and 12, namely the transitions at $t=t_1$. If such an indication cannot be detected, the LED driver is controlled, in step 506, such that it performs a primary function, i.e. in dependence of the non-modulated control signal. If, however, such an indication can be detected, a modulated control signal is read at the control signal inlet 105/305 in step 508.

In a next step, step 510, it is checked whether the modulated control signal 164 has been completely captured. If this is not the case, the modulated control signal is continued to be read at the control signal inlet 105/305 in step 508.

If it is detected that the modulated control signal has been completely captured, the LED driver is operated, in step 512, such that it performs a secondary function in dependence of the completely captured modulated control signal. Once the secondary function has been implemented, the LED driver is controlled such that it returns into its primary state.

Figure 9:
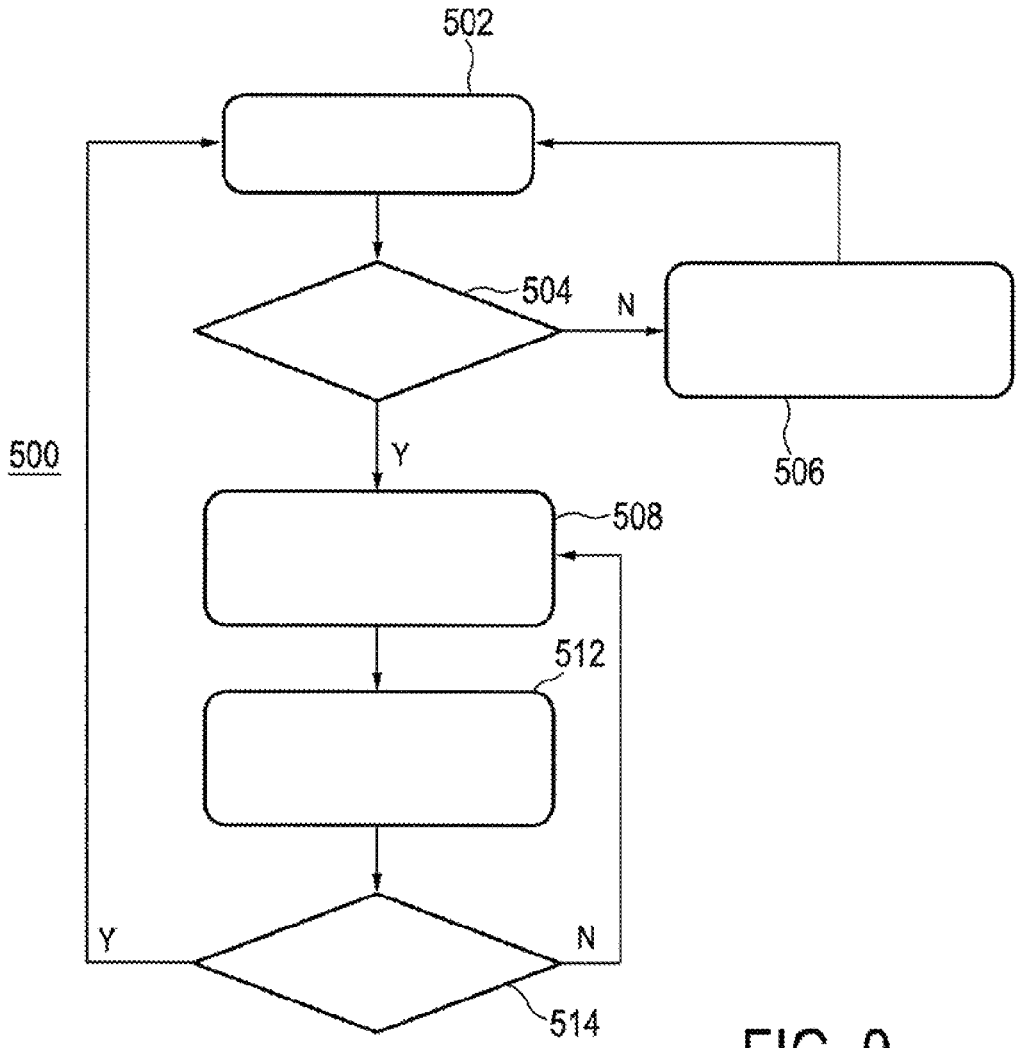
FIG. 9 shows exemplary a flowchart illustrating a further embodiment of a method for operating a LED driver.

FIG. 9 shows the further embodiment of the operating method. This method differs from the method depicted in FIG. 8 in that the LED driver is controlled, in step 512, such that it performs the secondary function in dependence of the modulated control signal as long as no new signal trend has been detected that would indicate an end of a modulation. Such checking occurs in step 514. If however, it is indicated that modulation of the control signal has been terminated, the LED driver is controlled such that it returns into its primary state and operates the LED in dependence of the non-modulated control signal (step 506).

Concerning the two methods just described, the LED driver can be informed about initiation/termination of a modulating of the control signal by a comparatively fast transition of the control signal value, i.e. by quickly varying the amplitude of the control signal. However, such an indication can certainly also be implemented in other ways, for example by performing a start/end pulse width modulation scheme on the control signal.

Variations to the disclosed embodiments can be understood and effected by those skilled in the art in practicing the claimed invention, from a study of the drawings, the disclosure, and the appended claims.

It shall be understood that an arrangement of elements of a respective figure predominately serves a purpose of an evident description; it does not relate to any actual geometric arrangement of parts of a manufactured device according to the invention. Referring in particular to the modulator, the control interface and the trigger means, it shall be understood that these components can be realized in an integrated module or separately from each other.

In the claims, the word "comprising" does not exclude other elements or steps, and the indefinite article "a" or "an" does not exclude a plurality.

A single unit or device may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The present invention concerns LED drivers and is in particular directed to signal overlay for feature addition to an existing LED driver. Specifically, the invention is directed to an apparatus for operating a LED driver, to a method of operating a LED driver, to a computer program for operating a LED driver and to a LED driver unit. The apparatus is capable of overlaying an overlay signal (digital or analogue) to a control signal of the LED driver in dependence of external control information. The control signal is provided to the LED driver at a control signal inlet. By overlaying the overlay signal, the apparatus modulates the control signal and provides a modulated control signal to the same control signal inlet.

LIST OF REFERENCES

100 LED driver according to the prior art
102 Ground
105 control signal inlet
120 LED
140 Power conversion stage
160 Programmable IC
162 Internal sensor
164 Non-modulated or modulated control signal
180 Mains interface
182 Power supply
184 Operating voltage Vcc
200 Apparatus
202 Input for control signal
204 Input for GND
206 Input for Vcc
208 Output for modulated/non-modulated control signal
210 Modulator
212 Transistor
214 Gate driver
220 Logic control
222 Switching array
250 Control interface
252 Light sensor

254 Other sensor
256 External control signal
258 Control interface output signal
300 LED driver
305 control signal inlet
310 Timer
312 Timer control signal
314 Timer interrupt
316 Timer trigger
320 Other hardware modules
322 first module control signal
324 second module control signal
330 ADC
332 ADC request
334 ADC data
336 ADC interrupt
338 ADC control signal
340 Comparator
342 Comparator start
344 Comparator stop
350 DAC
360 CPU
362 Internal sensor
400 LED driver unit
R10 low range
R20 normal range
R30 high range

The invention claimed is:

1. An apparatus for operating a LED driver, the apparatus being configured to be coupled to the LED driver and comprising:

an input configured to capture a value of a control signal, wherein the control signal is to be provided at a control signal inlet of the LED driver, such that the LED driver can control operation of a LED based on the provided control signal, and a modulator configured to modulate the control signal according to a predefined protocol and to provide the modulated control signal at the same control signal inlet, wherein a programmable internal control circuit of the LED driver is adapted to the predefined protocol, such that the LED driver is capable of controlling the LED in dependence of the modulated control signal generated by the apparatus.

2. The apparatus according to claim 1, wherein the modulator is configured to modulate the control signal in dependence of the captured control signal value.

3. The apparatus according to claim 1, additionally comprising trigger means that are configured to cause a transition of the control signal value from an inside (R20) of a predefined range to an outside (R10; R30) of the predefined range, the transition of the control signal value being indicative to the LED driver of an initiation and/or of a termination of a modulating of the control signal.

4. The apparatus according to claim 1, wherein the modulator is configured to perform a start pulse width modulation scheme and/or an end pulse width modulation scheme on the control signal, wherein the start pulse width modulation scheme is indicative to the LED driver that modulation of the control signal will be initiated and wherein the end pulse width modulation scheme is indicative to the LED driver that modulation of the control signal will be terminated.

5. The apparatus according to claim 1, wherein the apparatus is configured to control the LED driver such that the LED driver operates in a normal state, in which a LED is controlled in dependence of the non-modulated control signal, and the LED driver operates in a dynamic state, in which a LED is controlled in dependence of the modulated control signal.

6. The apparatus according to claim 1, additionally comprising a control interface coupled to the modulator, the control interface being configured to receive an external control signal originating from an environment of the LED driver, and to control modulation of the control signal in dependence of the received external control signal.

7. The apparatus according to claim 6, wherein the control interface includes an infrared sensor and the external control signal includes an infrared signal.

8. The apparatus according to claim 6, wherein the modulator includes a switching array, and wherein the switching array comprises a number of controllable switches and is configured to be set into a specific of a plurality of control states in dependence of respective switching states of the number of controllable switches;

each of the plurality of control states results in a respective specific control signal value; and wherein the modulator is configured to put the switching array into a specific control state in dependence of the external control signal.

9. A LED driver unit for driving a LED, the LED driver unit comprising a LED driver and an apparatus according to claim 1.

10. The LED driver unit according to claim 1, wherein the apparatus is operatively connected to the LED driver via an Analog-to-Digital-Converter of the LED driver, wherein the Analog-to-Digital-Converter is configured to receive the modulated or non-modulated control signal and to provide a digital control signal to the internal control circuit in dependence of the received signal.

11. The LED driver unit according to claim 1, wherein the LED driver comprises a comparator that is configured to detect a transition of the value of the control signal between an inside (R20) and an outside (R10; R30) of a predefined range and to provide a comparator output signal to the internal control circuit of the LED driver, if such transition occurs, wherein the comparator output signal is indicative of an initiation or, respectively, a termination of a modulation of the control signal.

12. The LED driver unit according to claim 1, wherein the LED driver comprises a timer that is configured to provide an interrupt signal to the internal control circuit, wherein the LED driver is configured to operate in a normal state, in which a LED is controlled in dependence of the non-modulated control signal, if the interrupt signal is inactive, and the LED driver is configured to operate in a dynamic state, in which a LED is controlled in dependence of the modulated control signal, if the interrupt signal is active.

13. A Non-transitory computer readable storage medium including instructions for causing the apparatus as defined in claim 1 to:

capture a value of a control signal, wherein the control signal is to be provided at a control signal inlet of the LED driver, such that the LED driver can control operation of a LED based on the provided control signal;

modulate the control signal according to a predefined protocol; and provide the modulated control signal at the same control signal inlet, modulate the control signal according to a predefined protocol, wherein the computer program is run on a computer controlling the apparatus.

14. A method of operating a LED driver, the method comprising the steps of:

capturing a value of a control signal, wherein the control signal is to be provided at a control signal inlet of the LED driver, such that the LED driver can control operation of a LED based on the provided control signal;

modulating the control signal according to a predefined protocol; and providing the modulated control signal at the same control signal inlet, wherein a programmable internal control circuit of the LED driver is adapted to the predefined protocol, such that the LED driver is capable of controlling the LED in dependence of the modulated control signal generated by the apparatus.

* * * * *